United States Patent [19]

Alskog

[11] 3,973,932

[45] Aug. 10, 1976

[54] APPARATUS FOR ELECTRODYNAMICALLY SEPARATING PARTICLES FROM A GAS

[75] Inventor: A. Magnus Alskog, Skara, Sweden

[73] Assignee: AB Lectrostatic, Skara, Sweden

[22] Filed: Apr. 23, 1974

[21] Appl. No.: 463,418

[52] U.S. Cl. ..... 55/132; 55/112; 55/113; 55/139; 55/142; 55/156; 55/481

[51] Int. Cl.[2] ..... B03C 3/51

[58] Field of Search ..... 55/101, 108, 112, 113, 55/114, 121, 124, 126, 128, 129, 130, 131, 132, 136, 137, 138, 139, 140, 141, 142, 149, 150, 151, 154, 155, 156, 278, 481, 524

[56] References Cited

UNITED STATES PATENTS

| | | | |
|---|---|---|---|
| 1,407,311 | 2/1922 | Witte | 55/124 |
| 2,555,339 | 6/1951 | Hedberg | 55/155 X |
| 2,579,441 | 12/1951 | Palmer | 55/131 |
| 2,672,207 | 3/1954 | Hedberg | 55/154 X |
| 2,712,362 | 7/1955 | Winklepleck | 55/121 X |
| 2,769,505 | 11/1956 | Maas | 55/154 X |
| 2,906,512 | 9/1959 | Meek | 55/524 X |
| 2,979,158 | 4/1961 | Vlier, Jr. | 55/142 X |
| 3,149,936 | 9/1964 | Rich | 55/114 |
| 3,172,747 | 3/1965 | Nodolf | 55/126 X |
| 3,242,649 | 3/1966 | Rivers | 55/132 |
| 3,386,227 | 6/1968 | Czerwonka | 55/155 X |
| 3,487,610 | 1/1970 | Brown et al. | 161/412 X |
| 3,555,818 | 1/1971 | Vlier | 55/138 X;132 |
| 3,668,836 | 6/1972 | Craig et al. | 55/131 |

FOREIGN PATENTS OR APPLICATIONS

| | | | |
|---|---|---|---|
| 600,967 | 7/1960 | Canada | 55/155 |
| 1,031,266 | 3/1953 | France | 55/481 |
| 418,551 | 10/1934 | United Kingdom | 55/118 |

*Primary Examiner*—Frank W. Lutter
*Assistant Examiner*—David L. Lacey
*Attorney, Agent, or Firm*—Burns, Doane, Swecker & Mathis

[57] ABSTRACT

An apparatus for electrically separating particles from a gaseous stream in which high-tension means and a plurality of earthed collecting means are positioned in a housing having inlet and outlet means for flow of the gaseous stream therebetween. The high-tension means is connected to a source of high voltage direct current and charges the particles in the gaseous stream. The plurality of earthed collecting elements are disposed in the gaseous stream in the housing to collect charged particles in the gaseous stream. Each collecting element comprises a matrix of alternate flat paper strips and corrugated paper strips glued to each other to form through-flow channels for the gaseous stream. The periphery of the matrix is connected with an electrically conducting, earthed metallic layer to form a block of corrugated paper with edge portions connected to current conducting earthing means. The block of corrugated paper is divided into layers along at least some of the flat paper strips and interleaved between the layers with electrically conducting metal foil each connected to the earthed metallic layer along the periphery of the block. The housing has an opening to receive the collecting elements therein and the housing includes supporting means for supporting the collecting elements in the gaseous stream within the housing. The high-tension means are disposed between the collecting elements in the housing, preferably with at least one collecting element positioned between the first high-tension means and the inlet.

2 Claims, 6 Drawing Figures

APPARATUS FOR ELECTRODYNAMICALLY SEPARATING PARTICLES FROM A GAS

BACKGROUND OF THE INVENTION

The invention relates to an apparatus for electrodynamically separating particles from a gaseous stream comprising high-tension voltage means for charging the particles in the gaseous stream, there being arranged in the gaseous stream at least one collecting element for the charged particles.

The definition of "electrodynamic separation" has been used here to achieve a clear distincion of the invention against conventional electrostatic apparatuses in which separation of uncharged particles is achieved on an electrostatically charged collecting element. Such an electrostatic filter is described, for example, in the U.S. Pat. No. 3,487,610. The filter comprises permanently charged elements which are kept separate from each other by spacing pieces of a dielectric insulation material, e.g. a block of corrugated paper, through the flutes of which the gaseous stream is led. When the spacer block is first applied to the electrically charged surface of an element, the spacer block may be considered as a large electrically uncharged particle which by degrees takes a charge from the permanently charged elements placed on the two opposing sides of the spacing block. Each spacing block incorporated in the filter will get a charge dependent on the element, and a neutral zone is achieved in the middle portion of the spacer block. This signifies that the corrugated kraft paper blocks may be regarded as extensions of the adjacent statically charged elements. Uncharged particles will pass into the flutes of the spacer blocks, and as the blocks are statically charged, the particles will be caught up on the flute walls with the exception of the central and neutral zone in each spacer block, where the particles pass freely through. Particles which have been caught or collected will be quickly charged to the same potential as the associated flutes, attraction forces thereby ceasing, which gives the particles a tendency to loosen and leave the filter.

Even if the electrostatic apparatus described in the U.S. Pat. No. 3,487,610 constitutes an improvement over other electrostatic apparatuses, it cannot, however, be compared with the considerably more effective but more expensive electrodynamic apparatuses.

In the construction of electrodynamic apparatuses, the collecting elements consist of perforated plates, or the like, of metal with good electrical conducting ability. Such collecting elements, which are earthed with regard to high-tension voltage, constantly lead a current to earth, and catching the particles charged in a high-tension field will be extremely effective. Attempts have also been made to use different semi-conductor material for the collecting elements, but so far such collecting elements have not been brought into commercial use. A disadvantage with both types of collecting element is their weight, the cost of fabricating them, and that as a rule a large number of collecting elements with intermediate electrodes must be provided, since the charge on collected, charged particles gradually decays to earth potential and the particle can then loosen from the surface of the collecting elements. A subsequent collecting element then entrains such particles plucked off by the gaseous stream, and these particles will possibly be united with previously entrained particles to form larger and heavier agglomerates which fall to the bottom of the filter apparatus.

It naturally follows that such a filter will be voluminous, expensive and heavy.

An object of the invention is therefore to achieve an electrodynamic filtering apparatus in which the charge in the charged entrained particles very slowly decays to earth potential, and in which particle lumps having a large mass are quickly formed, whereby the number of collecting elements can be kept to a minimum and a corresponding reduction of the number of high tension electrodes is obtained.

It is further an object of the invention to achieve a light and cheap collecting element consisting of a web of network of paper provided with through-flow channels, on the walls of which the charged particles are collected and retained in the form of lumps and particle layers.

Practical tests have shown that the charged particles caught on such earthed elements fabricated from paper will always generally have a potential differing from earth potential, there being attraction forces between the particles and the channel walls all the while the apparatus is supplied with voltage. The reason for this surprising effect would appear to be that paper is an extremely bad electrical conductor, and that each new charged particle which is collected, and which will then lie in contact with a previously entrained particle, will transfer a portion of its charge to said particle and not only to the collecting element.

According to one embodiment the collecting element or elements incorporated in the apparatus have a thickness of some few centimeters, whereat the channels have a length which is the same as the thickness of the element.

Such an element can suitably have a corrugated paper-like structure, i.e. it can consist of alternate flat layers of paper corresponding to the corrugated paper liner, and corrugated layers corresponding to the corrugated paper fluting. It has been found that most kinds of paper have a sufficient electrical conduction ability for effectively earthing the element. Earthing can be suitably implemented by the periphery of the element being provided with a metal foil which is earthed. The web or network of paper shall thus preferably consist exclusively of paper and the glue required to form the structure resembling corrugated paper. To diminish the risk of combustion, the paper can be impregnated with a fire retarding medium such as waterglass.

An increased separating effect can be obtained by an element of this kind being divided up into two or more thinner part elements, separated by narrow gaps. The increased effect appears to depend on the particles having a tendency primarily to deposit themselves on the edges of the walls forming the channels through the element.

A collecting element of the above described type should be so arranged in the apparatus that it can be removed individually and preferably during operation. Since the element consists of paper it can be burnt together with entrained material. Aternatively, the material can be removed from the element which is then re-inserted in the apparatus.

BRIEF DESCRIPTION OF THE DRAWING

In the following, the invention will be more closely explained while referring to the accompanying drawings in which.

DETAILED DESCRIPTION

Figure 1:
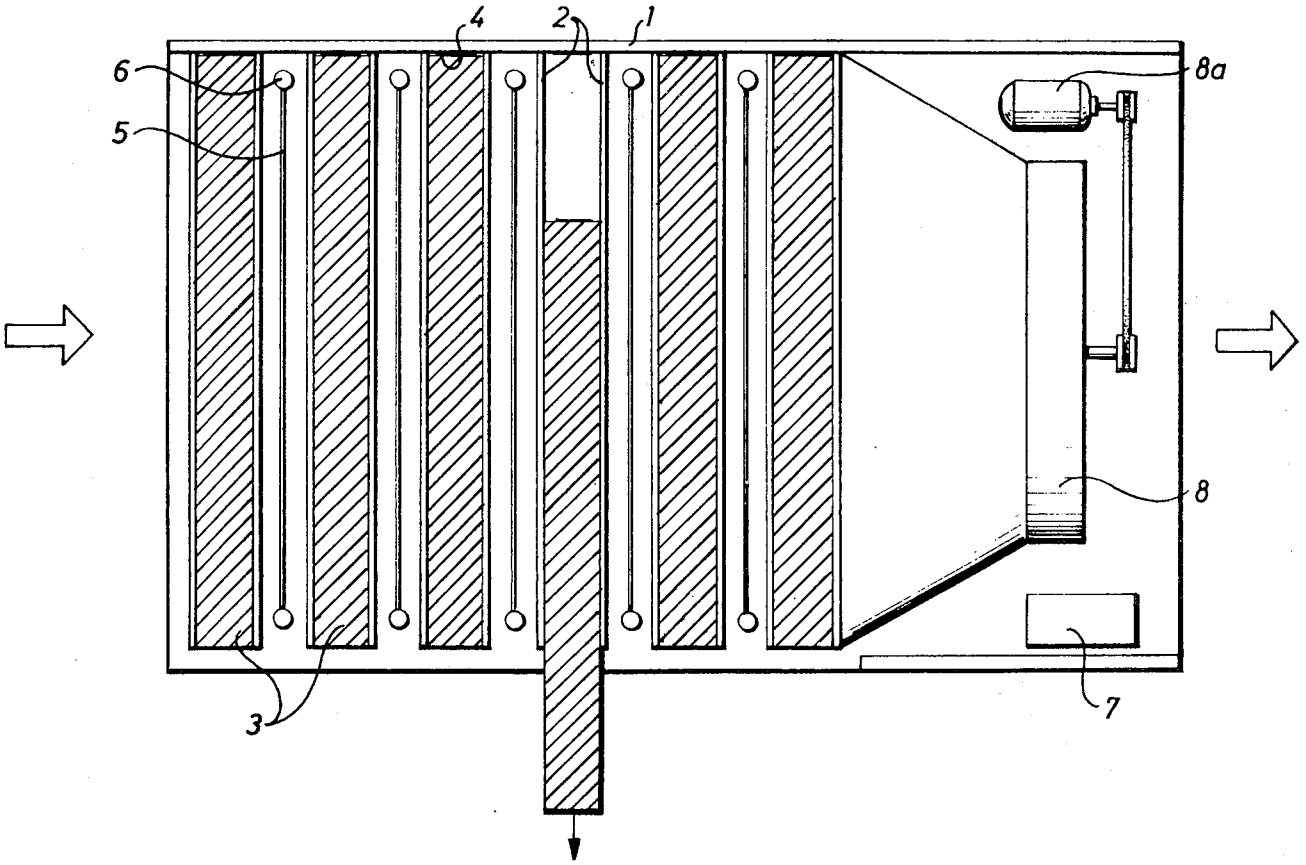
FIG. 1 is a horizontal section through an electrofilter according to the invention.
Figure 2:
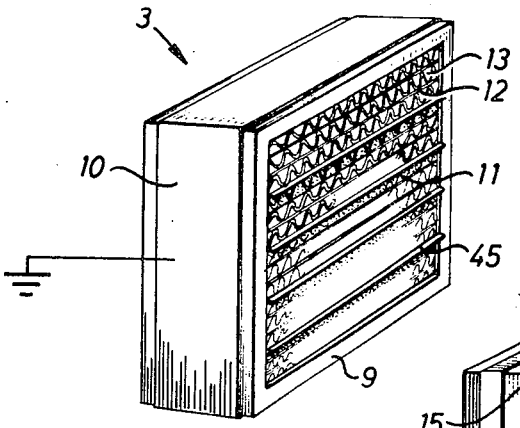
FIG. 2 shows a collecting element associated with the apparatus according to FIG. 1.

The electrofilter according to FIGS. 1 and 2 contains a housing 1 which is provided with a number of guiding rails 2, arranged upwardly and downwardly in pairs so that the collecting element 3 can be inserted in the filter through one of its side walls. Earthing contacts 4 are arranged in the housing to earth the collecting elements 3. In the housing there are further arranged high-tension electrodes consisting of a plurality of metal wires 5 mounted on vertical posts 6 between each pair of adjacent collecting electrodes. The high-tension electrodes are connected to a high-tension unit 7 fed from the AC supply, and which supplies DC current with a voltage of preferably at least 6000 volts. By means of this high voltage the wires 5 generate a corona discharge, which in a manner known per se achieves the desired charging of particles in the gas which can consist of air. In the housing 1 there is further a fan 8 driven by a motor 8*a*, for generating an air stream in the direction of the arrows through the filter, the air passing through each of the high-tension electrodes 5 and the collecting elements 3 in turn.

The collecting element 3 consists, in the example shown in FIG. 2, of a rectangular frame 9 made from wood or cardboard. A thin metal layer 10, suitably an aluminium foil is glued onto the outside of the frame to give an effective earth. In the frame a corrugated paper-like structure 11 is arranged, consisting of alternate flat paper strips 12 and corrugated paper strips 13, glued to each other. The catching element will therefore contain a large number of channels for the air streaming through. The channels extend in the lengthwise direction of the electrofilter, and only offer a very low flow resistance to the air. A certain minor flow resistance is desirable though, in order that the air shall be uniformly distributed over the whole surface of the element. The dimensions of the channels should be such that a particle in the air in a channel is never further than some few millimeters distance from the wall of the channel, so that the charged particles will have a short distance to traverse before arriving at an earthed surface. With a structure resembling corrugated paper, where the channels have a cross sectional shape like a "wave", this means that the wave preferably has a width of 7–10 mm and a height of 4–7 mm. In channels having other cross sections, the maximum width of the channel should be 6–7 mm.

Between the corrugated paper layers there are in the embodiment shown four metal strips 45, suitably consisting of aluminium foil. At their ends, these strips 45 are united with a metal layer 10, and they have a width causing them to extend some millimeters outside the corrugated paper strips. If a wire in the high-tension electrodes breaks, it will then come into contact with one of the metal strips 45. Because of the good earthing connection there will be a heavy short circuit which blows the fuses through which the apparatus is connected to the electrical supply, causing immediate interruption of the current to the apparatus and thereby preventing the occurance of fire.

The incoming air will first pass through an earthed collecting element 3 before it passes the first high-tension electrode 5. If the incoming air contains charged particles these will be deposited on the first collecting element. Such charged particles otherwise have a tendency to be deposited on the first high-tension electrode, which is not desirable since the high-tension wires are best kept clean.

When a collecting element 3 has been coated with material to the extent that flow resistance to the air is substantially increased, it is removed from the filter. The element can be cleaned and replaced or it can be burnt together with the collected material.

Figure 3:
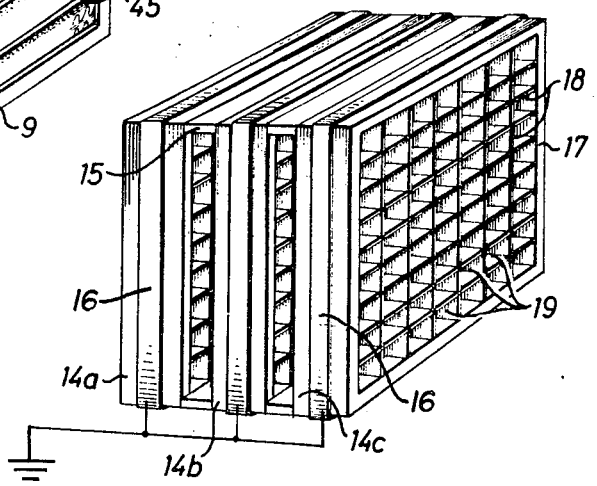
FIG. 3 shows an alternative embodiment of the collecting element.

FIG. 3 shows a collecting element consisting of three part elements 14a, 14b, 14c, assembled with a slight mutual distance effected by spacer rails 15. Each part element consists of a rectangular frame 17 containing horizontal and vertical strips 18 of paper or cardboard forming a system of air channels 19 having a square cross-section. The periphery of each part element is provided with an aluminium foil 16.

A charged particle in the air has a greater inclination to settle on an edge than on a surface in the catching element. While passing through channels 19 each particle passes at most six edges, and the element therefore has a greater efficiency and a larger capacity than an equivalently thick element which does not consist of several part elements.

Figure 4:
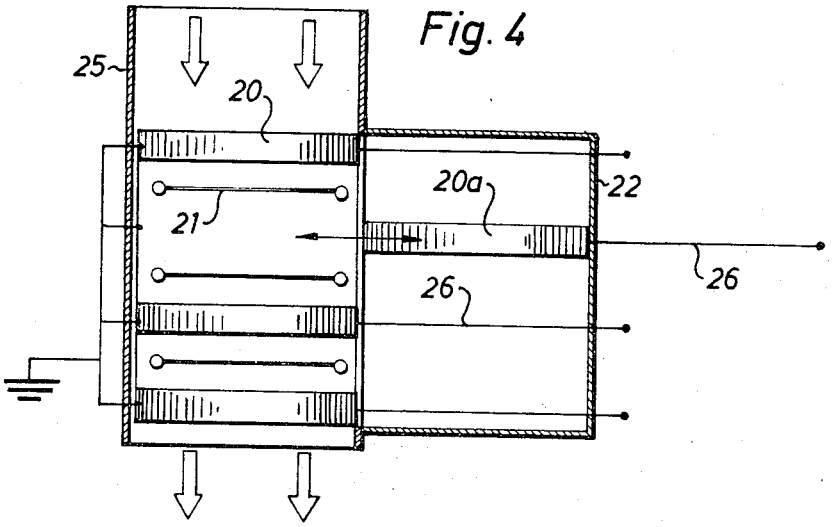
FIG. 4 is a horizontal view through another electrofilter according to the invention.
Figure 5:
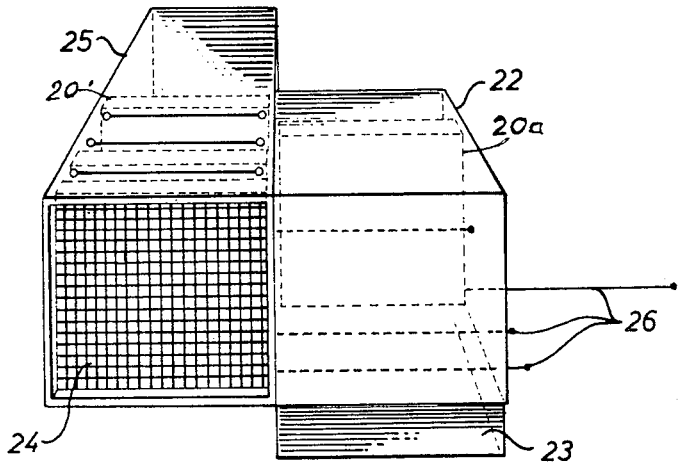
FIG. 5 is a perspective view of the electrofilter according to FIG. 4.

The electrofilter according to FIGS. 4 and 5 consists of a frame or housing 25 containing a plurality of collecting elements 20 with intermediate high-tension electrodes 21: Each collecting element consists of a rectangular frame carrying a network or web 24 of paper having quadratic channels. Parallel with the housing 25 a cleaning chamber 22 is arranged, which at its bottom has a material container 23. During cleaning, the collecting element 20 is pulled out to the position 20*a* in the cleaning chamber 22, with the help of a rod 26 attached to the collecting element and extending through the wall of the cleaning chamber. It is now sufficient with a light shaking of the element after pulling it into the cleaning chamber, for the material to loosen and fall down into container 23, after which the element is pushed back again into housing 25.

Figure 6:
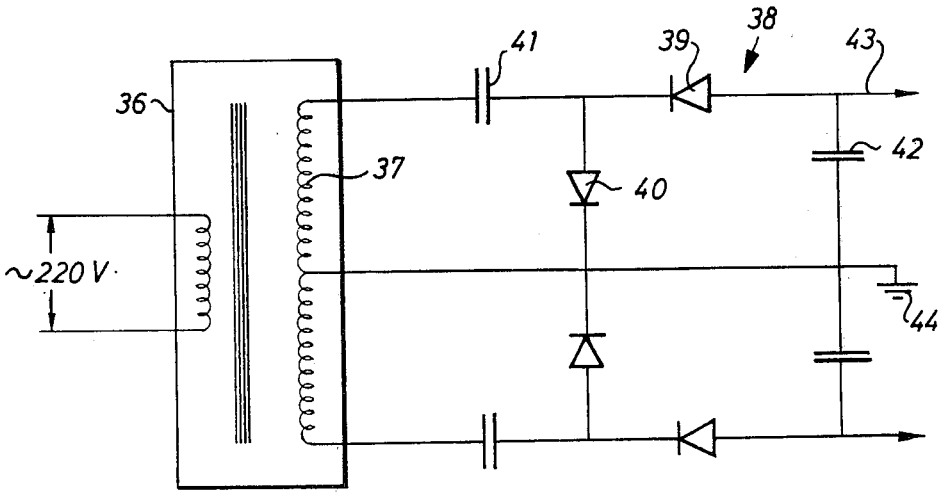
FIG. 6 shows a suitable electric circuit for a high-tension unit for the electrofilter according to the invention.

The circuit according to FIG. 6 contains a high-tension transformer 36, the secondary winding 37 of which is earthed at its middle point, two rectifiers 38 each containing two diodes 39, 40, and two capacitators 41, 42. The earthing connection 44 is connected to the earthing parts of the electrofilter, and the two cables 43 having the same negative potential in relation to earth are connected to the high-tension electrodes. With the circuit shown, doubling of the voltage is obtained. The resulting high-tension current has the character of direct current with a superimposed alternating current, i.e. an incompletely smoothed direct current. We have found that this nature of the direct current gives improved separation and a tighter packing of the separated material on the collecting elements, in comparison with a completely smoothed direct current.

The specific embodiment described above can be modified in different ways, and the number of ingoing electrodes and collecting elements can be varied within wide limits. In its simplest form the apparatus includes only one high-tension electrode, for charging particles in the inflowing air or other gas, and a single collecting element which consists of a single body of paper strips which are connected to each other or in contact with each other, and one or more sides of the block are in good electrical contact with an earthing bar or the like.

I claim:

1. An apparatus for electrically separating particles from a gaseous stream comprising:

a housing with inlet and outlet means for flow of the gaseous stream therebetween;

high-tension means in the housing for charging the particles in the gaseous stream, the high-tension means being connected to a source of high voltage direct current; and, a plurality of earthed collecting elements arranged in the housing to collect charged particles in the gaseous stream, each collecting element comprising a matrix of alternate flat paper strips and corrugated paper strips glued to each other to form through-flow channels for the gaseous stream, the periphery of the matrix being connected with an electrically conducting, earthed metallic layer to form a block of corrugated paper with edge portions connected to current conducting earthing means, the block of corrugated paper being divided into layers by spaced electrically conducting metal foil means interleaved between at least some portions of the matrix formed by said paper strips, each said electrically conducting metal foil means being connected to said earthed metallic layer along the periphery of the block, the housing having an opening to receive said collecting elements therein and including supporting means for supporting the collecting elements within the housing, the high-tension means being disposed between the collecting elements in the housing.

2. The apparatus of claim 1 wherein said block of corrugated paper includes first and second surfaces extending across the housing transverse to the flow of the gaseous stream through the housing, said electrically conducting metal foil means extending beyond said first and second surfaces.

* * * * *